US009453296B2

(12) United States Patent
Rockwell et al.

(10) Patent No.: US 9,453,296 B2
(45) Date of Patent: Sep. 27, 2016

(54) ACOUSTICALLY INSULATED MACHINE

(71) Applicant: Owens Corning Intellectual Capital, LLC, Toledo, OH (US)

(72) Inventors: Anthony L. Rockwell, Pickerington, OH (US); Phil Johnson, Louisville, KY (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 596 days.

(21) Appl. No.: 13/769,511

(22) Filed: Feb. 18, 2013

(65) Prior Publication Data

US 2014/0230497 A1 Aug. 21, 2014

(51) Int. Cl.

| | |
|---|---|
| ***D06F 37/24*** | (2006.01) |
| ***D06F 37/20*** | (2006.01) |
| ***D06F 39/12*** | (2006.01) |
| ***A47L 15/42*** | (2006.01) |

(52) U.S. Cl.

CPC ..... *D06F 37/24* (2013.01); *A47L 15/4255* (2013.01); *D06F 37/20* (2013.01); *D06F 39/12* (2013.01)

(58) Field of Classification Search

CPC ..... D06F 37/20; D06F 37/24; D06F 39/12; A47L 15/4255

See application file for complete search history.

(56) References Cited

U.S. PATENT DOCUMENTS

| | | | | |
|---|---|---|---|---|
| 2,959,966 | A * | 11/1960 | Bochan | D06F 23/04 210/365 |
| 2,995,023 | A * | 8/1961 | Douglas | D06F 13/02 366/128 |
| 5,056,341 | A * | 10/1991 | Mori | D06F 39/12 206/320 |
| 5,263,343 | A | 11/1993 | Lee | |
| 5,515,702 | A * | 5/1996 | Park | D06F 39/12 134/201 |
| 5,855,353 | A | 1/1999 | Shaffer et al. | |
| 6,196,029 | B1 | 3/2001 | Melia et al. | |
| 6,512,831 | B1 * | 1/2003 | Herreman | A47L 15/4255 181/198 |
| 6,539,955 | B1 | 4/2003 | Tilton et al. | |
| 6,807,700 | B2 | 10/2004 | Panther et al. | |
| 7,128,561 | B2 | 10/2006 | Rockwell et al. | |
| 7,159,836 | B2 | 1/2007 | Parks et al. | |
| 7,226,879 | B2 | 6/2007 | Tilton et al. | |
| 7,357,974 | B2 | 4/2008 | Rockwell | |
| 7,409,959 | B2 * | 8/2008 | Retsema | A47L 15/4255 134/200 |
| 7,748,796 | B2 | 7/2010 | Rockwell et al. | |
| 7,765,838 | B2 | 8/2010 | Kim et al. | |

(Continued)

FOREIGN PATENT DOCUMENTS

| | | |
|---|---|---|
| JP | 2002-306889 | 10/2002 |
| WO | 2011/084953 | 7/2011 |

OTHER PUBLICATIONS

International Search Report and Written Opinion from PCT/US11/020124 dated Aug. 4, 2011.

*Primary Examiner* — Joseph L Perrin

(74) *Attorney, Agent, or Firm* — Calfee, Halter & Griswold LLP

(57) ABSTRACT

A home appliance, such as a clothes washing machine, has a source of noise and an acoustic insulator. The source of noise moves between a first position and a second position during operation of the appliance. The acoustic insulator has a movable portion that moves with the source of noise between the first position and the second position during operation of the appliance and an interface that remains substantially stationary as the source of noise moves between the first and second positions.

11 Claims, 13 Drawing Sheets

(56) References Cited

U.S. PATENT DOCUMENTS

| | | | | |
|---|---|---|---|---|
| 7,827,753 | B2 | 11/2010 | Nagarajan et al. | |
| D629,556 | S | 12/2010 | Alter et al. | |
| 7,923,092 | B2 | 4/2011 | Rockwell | |
| 2002/0042957 | A1* | 4/2002 | Kim | D06F 23/04 8/158 |
| 2005/0191921 | A1 | 9/2005 | Tilton et al. | |
| 2006/0008614 | A1 | 1/2006 | Rockwell et al. | |
| 2006/0008616 | A1 | 1/2006 | Dean et al. | |
| 2007/0042156 | A1* | 2/2007 | Rockwell | B26F 1/22 428/116 |
| 2007/0054090 | A1 | 3/2007 | Rockwell | |
| 2007/0212970 | A1 | 9/2007 | Rockwell et al. | |
| 2007/0243366 | A1 | 10/2007 | Tilton et al. | |
| 2007/0272285 | A1 | 11/2007 | Herreman et al. | |
| 2008/0145630 | A1 | 6/2008 | Rockwell | |
| 2008/0289664 | A1 | 11/2008 | Rockwell et al. | |
| 2008/0290770 | A1* | 11/2008 | Rockwell | A47L 15/4246 312/228 |
| 2008/0317996 | A1 | 12/2008 | Rockwell | |
| 2009/0038980 | A1 | 2/2009 | Rockwell et al. | |
| 2009/0094908 | A1 | 4/2009 | Krueger et al. | |
| 2009/0301022 | A1 | 12/2009 | Rockwell et al. | |
| 2010/0024851 | A1 | 2/2010 | Rockwell et al. | |
| 2010/0187958 | A1* | 7/2010 | Colon | D06F 39/12 312/228 |
| 2011/0069498 | A1 | 3/2011 | Alter et al. | |
| 2011/0086214 | A1 | 4/2011 | Rockwell | |
| 2011/0233086 | A1 | 9/2011 | Rockwell et al. | |
| 2012/0012420 | A1* | 1/2012 | Classen | A47L 15/4246 181/294 |
| 2012/0169194 | A1 | 7/2012 | Maderic et al. | |
| 2012/0200210 | A1 | 8/2012 | Rockwell | |
| 2012/0298154 | A1 | 11/2012 | Rockwell et al. | |
| 2013/0174435 | A1 | 7/2013 | Rockwell et al. | |
| 2013/0193826 | A1* | 8/2013 | Fritz | D06F 39/12 312/400 |
| 2013/0266787 | A1 | 10/2013 | Rockwell et al. | |
| 2013/0337205 | A1 | 12/2013 | Rockwell et al. | |
| 2015/0097472 | A1 | 4/2015 | Rockwell | |
| 2015/0218803 | A1 | 8/2015 | Rockwell | |
| 2015/0233110 | A1 | 8/2015 | Alter et al. | |
| 2015/0250375 | A1 | 9/2015 | Rockwell et al. | |
| 2015/0368852 | A1 | 12/2015 | Rockwell et al. | |

* cited by examiner

ACOUSTICALLY INSULATED MACHINE

FIELD OF THE INVENTION

This invention relates in general to acoustically insulated machines. More particularly, this invention pertains to appliances, such as washing machines, having a motor or other sound generating component that moves from a first position to a second position when the appliance is operated.

BACKGROUND OF THE INVENTION

Appliances and other machines that generate noise are usually provided with acoustical insulation to reduce the levels of emanating sound. The unwanted sound from these machines can be caused both by the mechanical operation of the motor or other mechanical components within the machine and by the vibration of the machine itself. In a residential dwelling, excessive noise may be generated by dishwashers, clothes washers, clothes dryers, refrigerators, freezers, and microwave ovens, which can be annoying to inhabitants of the dwelling.

SUMMARY

A home appliance, such as a clothes washing machine, has a source of noise and an acoustic insulator. The source of noise moves between a first position and a second position during operation of the appliance. The acoustic insulator has a movable portion that moves with the source of noise between the first position and the second position during operation of the appliance and an interface that remains substantially stationary as the source of noise moves between the first and second positions.

BRIEF DESCRIPTION OF THE DRAWINGS

The accompanying drawings are incorporated in and form a part of this specification, illustrate several aspects of the present invention, and together with the description serve to explain certain principles of the invention. In the drawings.

DESCRIPTION OF EMBODIMENTS

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

Figure 1:
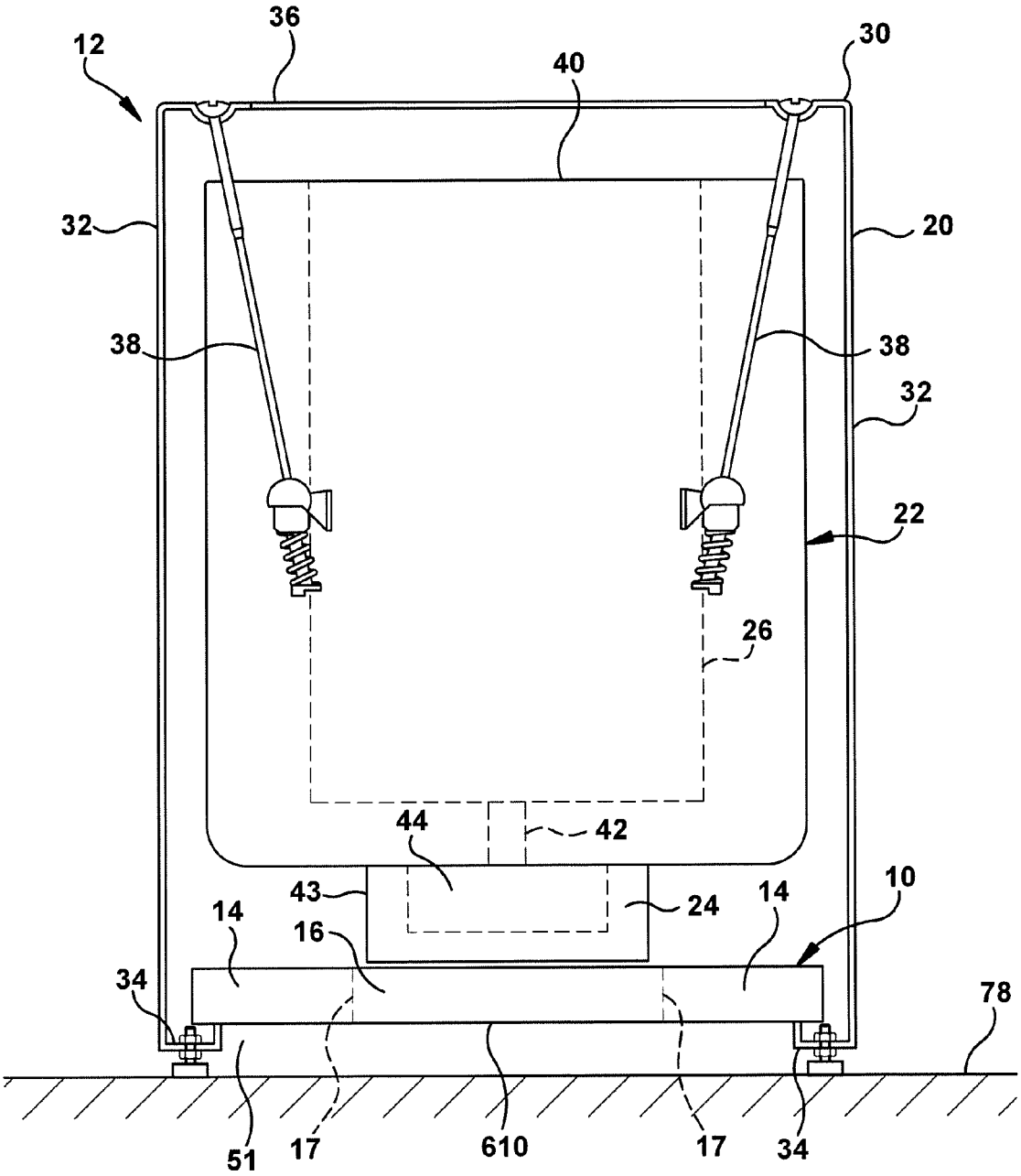
FIG. 1 is a schematic illustration of an exemplary embodiment of a washing machine having an acoustic insulator with a moveable portion.

The description and figures disclose acoustic insulators 10, machines 12 with acoustic insulators, including, but not limited to washing machines 12 with acoustic insulators 10, and methods of acoustically insulating a machine, such as a washing machine. Referring to FIG. 1, generally, the acoustic insulator 10 is configured such that a portion 16 of the acoustic insulator moves with a noise producing component, such as a motor 24, from a first position to a second position during operation of the machine 12. For example, when a washing machine 12 is empty, the motor 24 is at the position illustrated by FIG. 1. When the washing machine 12 is loaded with clothes and/or filled with water 25, the motor 24 moves in the direction illustrated by arrow 27 to the position illustrated by FIG. 2.

The illustrated machine 12 is a washing machine. The term "washing machine" as used herein, is defined to mean a machine designed to wash laundry items, such as clothing, towels, and sheets, that uses water as the primary cleaning solution. However, the insulators 10 disclosed by this application can be used with any machine having a noise generating component that moves between a first position and a second position. The acoustically insulated machine 12 may take a wide variety of different forms. For example, the acoustically insulated machine 12 may be a clothes washing machine, a dishwasher, an air conditioner, a microwave oven, a refrigerator, a freezer, or any other household machine or appliance that makes noise.

Figure 2:
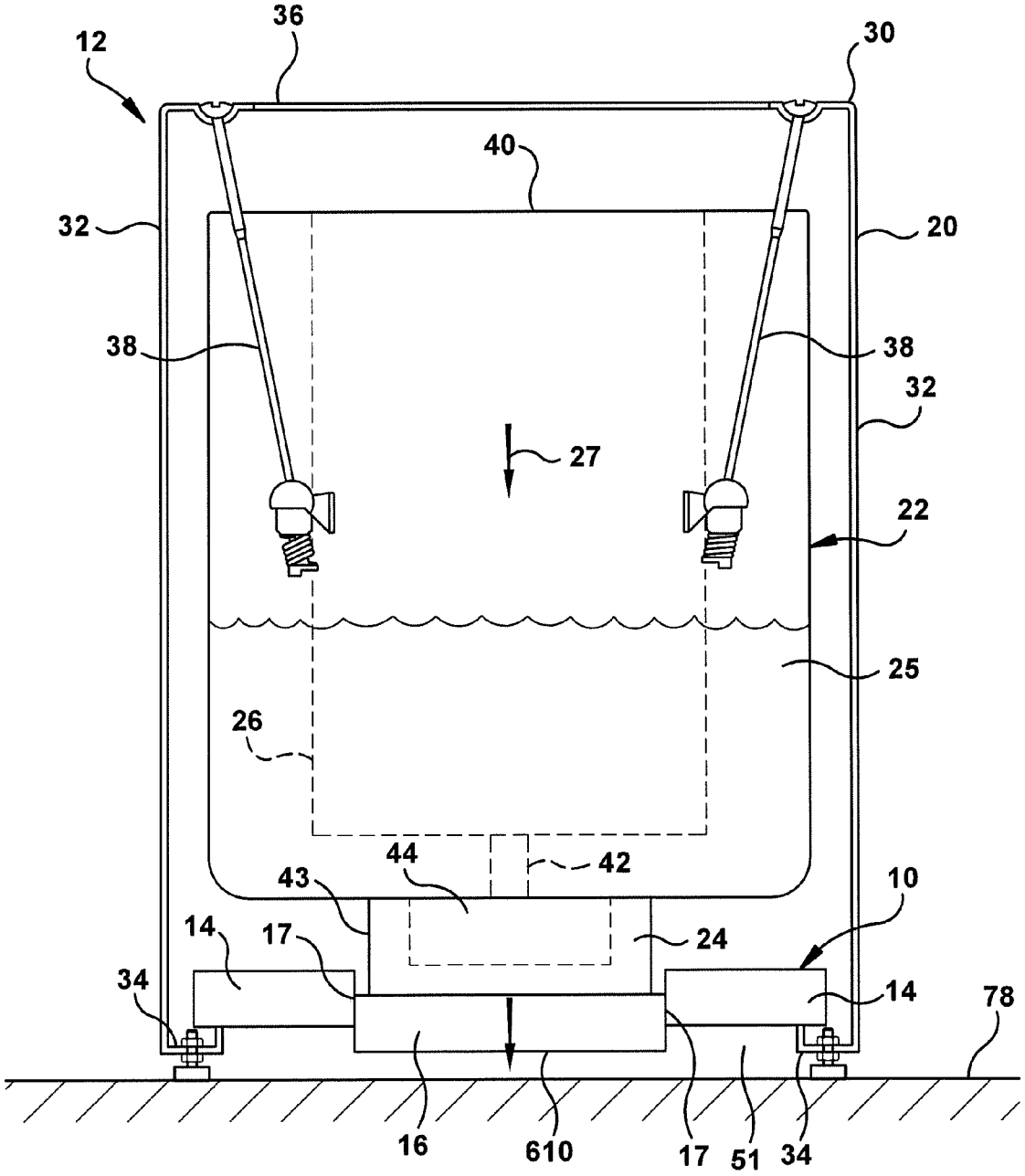
FIG. 2 is a view of the washing machine of FIG. 1 with the moveable portion moved downward.

In the exemplary embodiment illustrated by FIGS. 1 and 2, the portion 16 of the acoustic insulator 10 engages the motor 24 and/or is in close proximity with the motor at the position illustrated by FIG. 1. In the exemplary embodiment, the portion 16 stays in contact or close proximity with the motor at the position illustrated by FIG. 2, and as the motor 24 moves between the position illustrated by FIG. 1 and the position illustrated by FIG. 2. Further, in an exemplary embodiment, the portion 16 stays in contact or close proximity with the motor as the motor moves from the position illustrated by FIG. 2 back to the position illustrated by FIG. 1. By keeping the portion 16 of the insulator 10 engaged with or in close proximity with the motor 24, the effectiveness of the acoustic insulator is enhanced.

Referring now to FIG. 1, an acoustic insulator 10 is shown with an associated washing machine 12. The acoustic insulator 10 includes a moveable portion 16 and an interface 14. In the FIG. 1 example, the movable portion 14 and the interface 16 are illustrated as being integrally formed. However, the moveable portion 14 can be separately formed and moveably coupled to the interface 16. Examples of exemplary embodiments of the insulators 10 will be discussed in more detail below.

Referring again to FIG. 1, the illustrated washing machine 12 is a "top loading" machine. The term "top loading", as used herein, is defined to mean that an internal basket configured to retain laundry items during the washing cycle is oriented in an upright position and that the laundry items enter the basket from a top opening in the washing machine 10. However, the concepts of the acoustic insulator 10 can be applied to any type of washing machine. The illustrated washing machine 12 includes a cabinet 20, a tub 22, a motor assembly 24 and a basket 26.

As shown in FIG. 1, the cabinet 20 is configured to provide an enclosure for the internal components of the washing machine 12. The illustrated cabinet 20 includes a top surface 30, side surfaces 32 and bottom flanges. However, the cabinet 20 can take a variety of different forms. The cabinet 20 can be made from sheet metal and covered with a finish such as an enamel based finish. The cabinet can be made from a wide variety of different materials and/or combinations of materials. Examples of suitable materials for the cabinet include, but are not limited to plastic, fiberglass reinforced plastic, any type of sheet metal, etc. The cabinet 20 may have any finish. The cabinet 20 can be made from stainless steel sheet metal, and can have other desired finishes, such as for example a clear lacquer finish. The top surface 30 of the cabinet includes an opening 36. While the illustrated embodiment shows the cabinet as having a generally rectangular cross-sectional shape, it should be appreciated that the cabinet can have other cross-sectional shapes.

Referring again to the example of FIG. 1, the illustrated tub 22 is suspended within the cabinet 20 and is configured to retain water 25 (see FIG. 2) used for washing the laundry items. The tub 22 can take a wide variety of different forms and can be made from a wide variety of different materials. The tub 22 may be generally cylindrical with an open top 40 as shown, but may take a variety of different shapes. The tub may be made from plastic/polymeric materials, or metals, such as steel stainless steel, and aluminum. Preferably, the tub is made from a material that is resistant to corrosion when exposed to water or at least the inside surface of the tub is coated with a material that is resistant to corrosion when exposed to water.

As shown in the example of FIG. 1, the tub 22 is connected to ends of a plurality of suspension devices 38. The other ends of the suspension devices 38 being coupled to the cabinet 20. In the illustrated embodiment, the suspension devices 38 are coupled to the top surface 30 of the cabinet 20. The suspension devices 38 are configured to allow vertical movement of the tub 22 with respect to the cabinet 20 while limiting rotational movement of the tub 22 with respect to the cabinet 20. For example, the tub 22 may be in the position illustrated by FIG. 1 when the tub 22 is empty and in about the position illustrated by FIG. 1 (or slightly lower) when the basket 26 is loaded with clothes, but the tub 22 is not yet filled with water 25. When the tub 22 is filled with water 25, the weight of the water acts against the countering forces applied by the suspension devices 38 and moves the tub 22 downward to the position illustrated by FIG. 2. As such, when the washing machine 12 is in a wash or a rinse cycle, the tub 22 will be at or move downward toward the position illustrated by FIG. 2. When the washing machine is in a spin cycle, (i.e., the water is removed from the tub 22) the tub 22 will be at or move upward toward the position illustrated by FIG. 1.

In the illustrated embodiment, the suspension devices 38 are a combination of rods, springs and attachment mechanisms. However, the tub 22 may be coupled to the cabinet 20 in a wide variety of different ways. In other embodiments, the suspension devices 38 can be any desired structure, mechanism or device sufficient to suspend the tub 22 within the cabinet 20. The suspension devices 38 allow vertical movement of the tub 22 with respect to the cabinet 20, while limiting rotation of the tub, or otherwise couples the tub 22 to the cabinet 20. The tub 22 has a top opening 40.

Referring again to the example illustrated by FIG. 1, the motor assembly 24 is positioned below the tub 22. The illustrated motor assembly 24 is configured to rotate the basket 26 via shaft 42. However, the motor assembly 24 may take a wide variety of different forms and may be coupled to the basket 26 in many different ways. The illustrated motor assembly 24 includes a stator housing 43 that is fixedly connected to a bottom of the tub 22. An internal rotor 44 is rotatably housed in the stator housing 43. The rotor 44 is connected to the shaft 42. Any rotor/stator configuration and coupling to the basket 26 may be employed. In an exemplary embodiment, the exposed portion of the motor assembly is fixed with respect to the tub 22. The exposed portion of the motor assembly 24 can have any cross-sectional shape, including the non-limiting examples of circular and square cross-sectional shapes.

Referring again to the example illustrated by FIG. 1, the basket 26 is positioned within the tub 22 and configured to retain the laundry items during the washing cycle. The basket 26 can take a wide variety of different forms and can be made from a wide variety of different materials. The basket 26 may be generally cylindrical with an open top as shown, but may take a variety of different shapes. The tub may be made from plastic/polymeric materials, or metals, such as steel, stainless steel, and aluminum. Preferably, the basket is made from a material that is resistant to corrosion when exposed to water or the tub is coated with a material that is resistant to corrosion when exposed to water.

The acoustic insulator 10 may take a wide variety of different forms. As mentioned above, the moveable portion 16 is movably coupled to the interface 14. The moveable portion 16 can be coupled to the interface in a wide variety of different ways. Any coupling arrangement 17 that allows the movable portion 16 to move downward with respect to the interface 14 as indicated by FIGS. 1 and 2 can be used. Examples of suitable coupling arrangements between the moveable portion 16 and the interface 14 include, but are not limited to, connections by resilient materials, such as rubber, providing reliefs or cuts in the material of the insulator, connecting the moveable portion 16 to the interface 14 with spring-like connectors, and the like.

Figure 3:
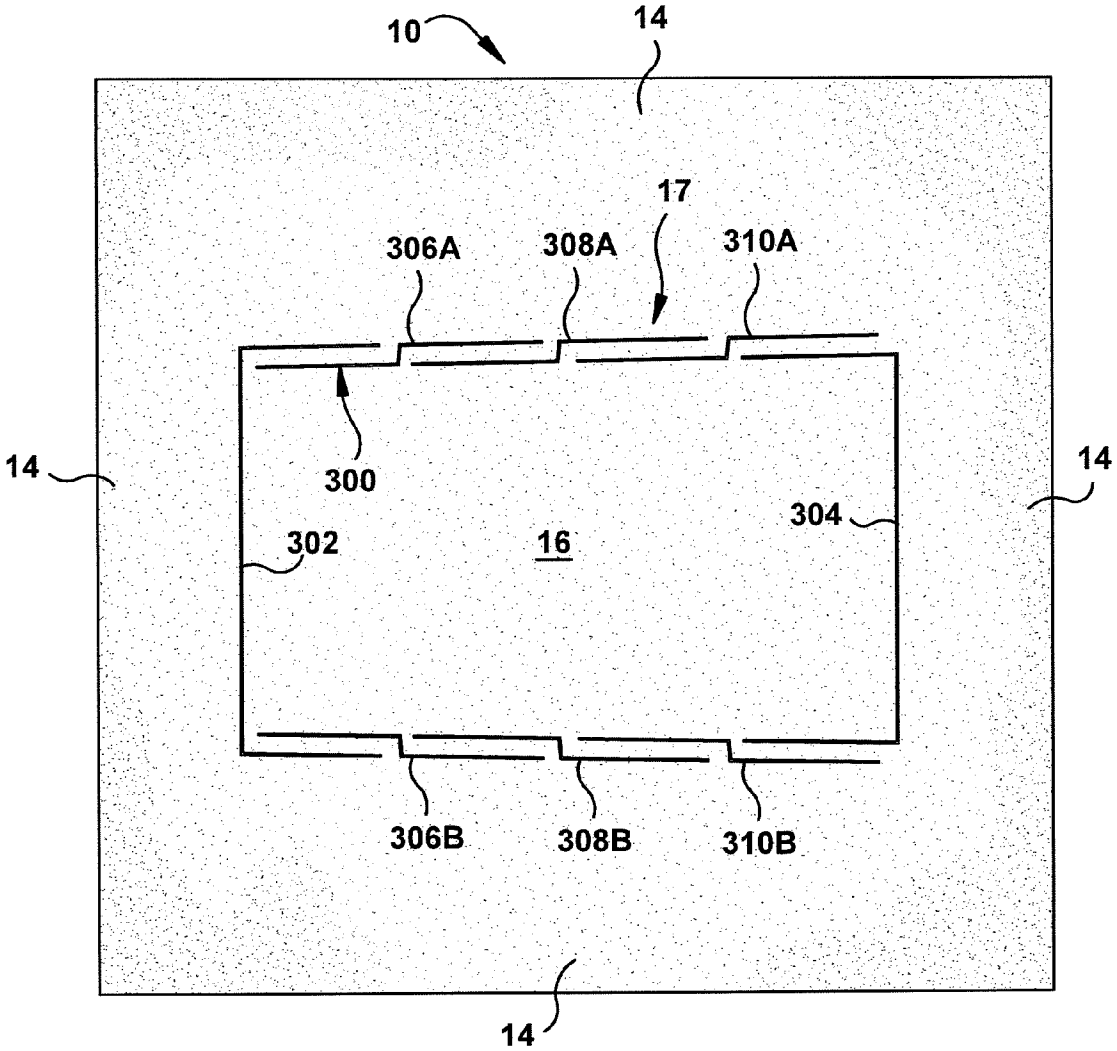
FIG. 3 is a bottom plan view of an exemplary embodiment of an acoustic insulator.
Figure 4:
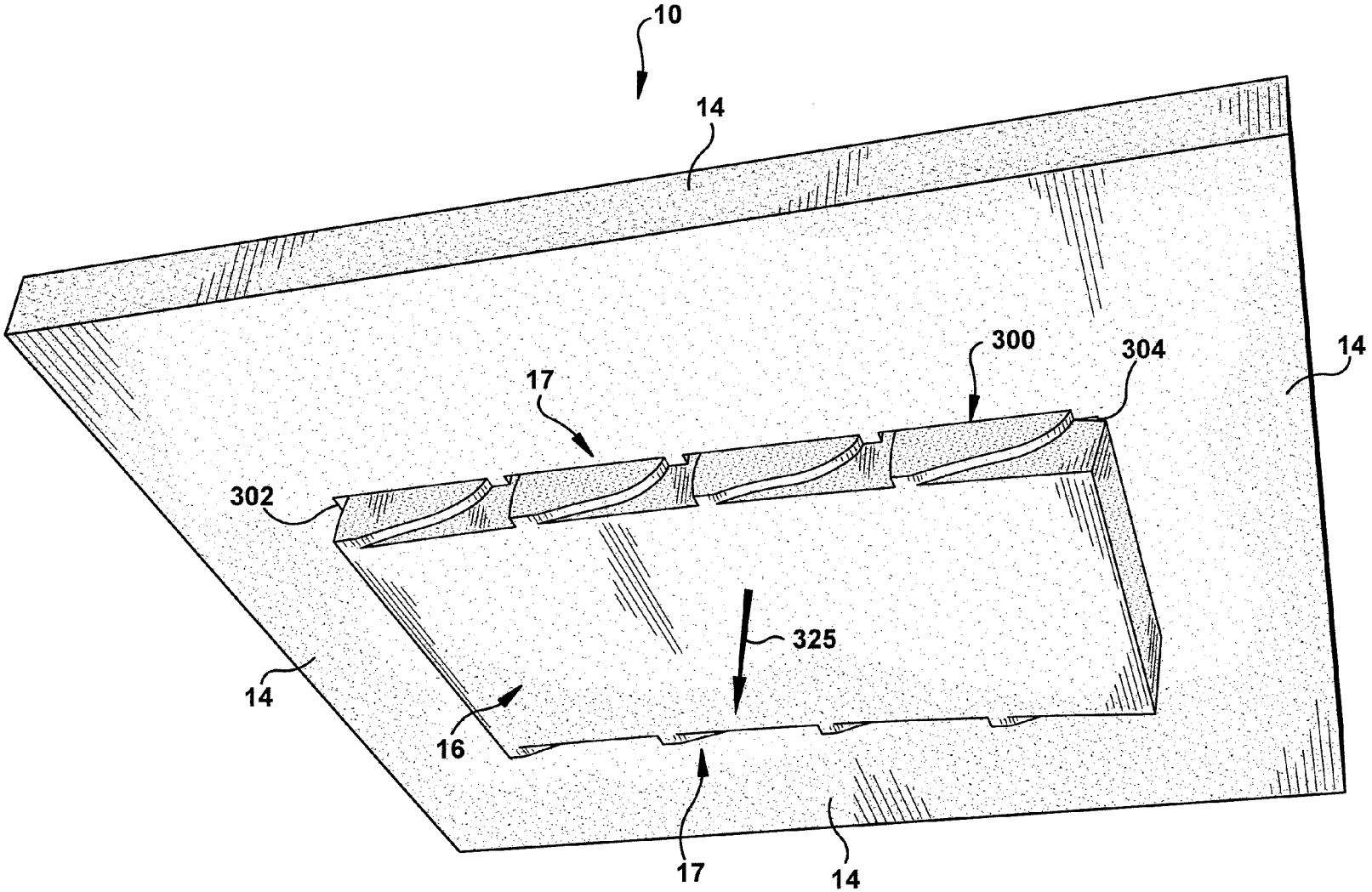
FIG. 4 is a bottom perspective view of the acoustic insulator illustrated by FIG. 3.

In the example illustrated by FIGS. 3 and 4, the coupling arrangement comprises a series of cuts 300 or reliefs. The cuts 300 or reliefs can take a wide variety of different forms. Any series of cuts 300 or reliefs that allows the movable portion 16 to move downward with respect to the interface 14 as indicated by FIGS. 1 and 2 can be used.

In the example illustrated by FIGS. 3 and 4, the series of cuts 300 or reliefs comprise a pair of "C" shaped cuts 302, 304 through the material of the acoustic insulator that face toward one another. The legs of the "C" 302 are spaced farther apart than the legs of the "C" 304. The series of cuts 300 or reliefs also comprise "Z" shaped cuts 306A, 306B, 308A, 308B, 310A, 310B, through the material of the acoustic insulator that extend from the "C" shaped cut 302 to the "C" shaped cut 304. One leg of each "Z" shaped cut 306A, 306B is disposed inside a leg of the "C" shaped cut 302. One leg of each "Z" shaped cut 308A, 308B is disposed inside the other leg of a corresponding "Z" shaped cut 306A, 306B. One leg of each "Z" shaped cut 310A, 310B is disposed inside the other leg of a corresponding "Z" shaped cut 308A, 308B. The legs of the "C" shaped cut 304 are disposed inside other legs of the "Z" shaped cuts 310A, 310B. This configuration allows the movable portion 16 to be moved downward with respect to the interface 14 as indicated by arrow 325 in FIG. 4. However, any arrangement or pattern of cuts through the material of the acoustic insulator 10, reliefs that do not extend all the way through the material of the insulator, and/or lines of weakness formed in the material of the insulator that allows for a desired movement of the moveable portion 16 with respect to the interface 14 can be used.

The moveable portion 16 and the interface 14 can take a wide variety of different forms. The interface 14 can take any form that allows the acoustic insulator 10 to be coupled to the machine 12 and that supports the moveable portion 16. In the illustrated embodiment, the interface 14 surrounds the moveable portion 16 and substantially fills an opening 51 of the machine 12. As such, the acoustic insulator 10 is able to dump substantially all of the noise generated by the motor 24, even though the moveable portion 16 moves with respect to the interface. The illustrated interface 14 is substantially rectangular in shape. However, the interface 14 can have any shape that is appropriate for the application that the acoustic insulator 10 is being used in.

The moveable portion 16 can take any form that covers or bock sound from a noise generating component, or a portion of a noise generating component. In the embodiment illustrated by FIGS. 3 and 4, moveable portion 16 is rectangular shape. However, the moveable portion can have a wide variety of different shapes.

The acoustic insulator 10 can be made from a wide variety of different materials. Any material capable of providing the desired acoustic properties can be used. The acoustic insulator 10 can be made from a single layer of a single material or any number of layers of the same or different materials. In one embodiment, the acoustic insulator 10 includes one or more porous, sound absorbing layer 320 and one or more dense or facing layers 322 attached to faces of the sound absorbing layer 320. The dense or facing layers 322 have a density that is greater than a density of the sound absorbing layer 320. The combination of one or more porous, sound absorbing layer 20 and one or more dense or facing layers allows a thin acoustic insulator 10 to provide the sound absorbing effectiveness of a thicker acoustic insulation member that is made only from porous, sound absorbing material.

Figure 5:
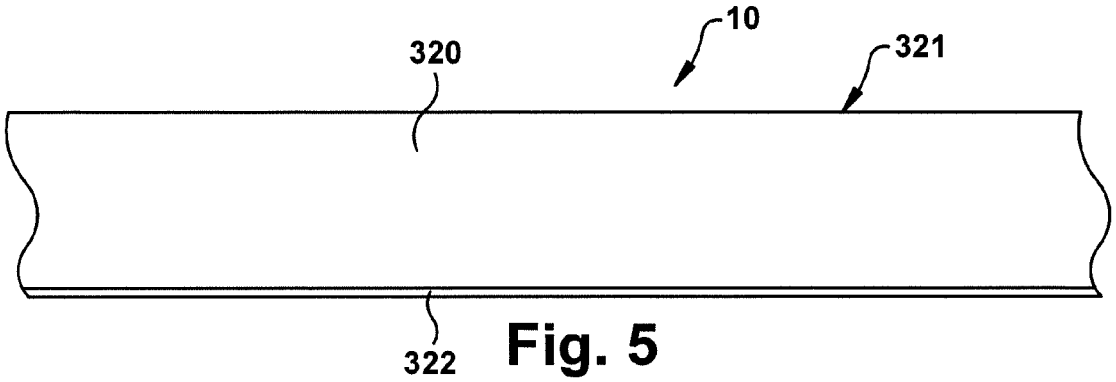
FIG. 5 is a sectional view of an exemplary embodiment of a material of an acoustic insulator.

FIG. 5 illustrates an exemplary embodiment of material that may be used for the acoustic insulators 10 disclosed herein. In the example illustrated by FIG. 5, the acoustic insulator 10 includes one porous, sound absorbing layer 320 and one dense or facing layer 322 attached to a face of the sound absorbing layer 320. These layers may be made from the same material, with the dense or facing layer formed by heating and/or compressing material of the acoustic insulator 10. However, the dense layer may be formed or provided in any manner and any number of each type and/or material of dense layer may be included.

The porous, sound absorbing layer 320 may be made from a wide variety of different materials. For example, the porous, sound absorbing layer 320 may be made from thermoplastic polymers, such as polyester, polyethylene terephthalate (PET), polypropylene and the like. In one exemplary embodiment, the sound absorbing layer 320 is made from a fine fiber PET material, such as a 2 denier fiber size PET material. The porous, sound absorbing layer 320 may be formed with a variety of different densities and lofts, which can be selected to adjust the acoustic performance of the acoustic insulator 10. In one exemplary embodiment, the porous, sound absorbing layer 20 is 15-300 grams per square foot and a thickness range of 0.5"-3". For example, in the embodiments illustrated by FIG. 3, the sound absorbing layer 320 may be a PET material, such as VersaMat 2110 (available from Owens Corning) that is 8 to 80 grams per square foot with a thickness of 6 to 40 mm. However, any combination of materials, lofts, and densities may be selected or changed to achieve different acoustic performance characteristics.

The facing layer(s) 322 can take a wide variety of different forms. In an exemplary embodiment, the facing 322 is a relatively permeable layer that allows noise and air to pass through the facing member. For example, the facing layer 322 may have an airflow resistance between about 600-1400 Rayls. The facing layer may have an airflow resistance between 900-1400 Rayls. The facing layer 322 may be selected to have an airflow resistance of about 900

Rayls, about 1100 Rayls, or about 1400 Rayls. However, other airflow resistances can be selected. In one exemplary embodiment, the facing layer 322 in the embodiment illustrated by FIG. 5 may have an airflow resistance of about 900, 1100 and/or 1400 Rayls.

The facing layers 322 can be made from a wide variety of different materials and may have a variety of different thicknesses. For example, any material having the airflow resistance described above can be used. Examples of acceptable materials for the facing layers 322 include, but are not limited to polypropylene, PET, non-porous materials that are perforated to allow airflow, such as perforated metal foil, perforated polymer material, such as a Teflon sheet that has been perforated to allow airflow. In another embodiment, acceptable materials for the facing layers 322 include, but are not limited to non-porous materials that are not perforated to allow airflow, such as metal foil, polymer material, such as a Teflon sheet.

The facing layers 322 may have a wide variety of different densities and thicknesses. In an exemplary embodiment, the facing is much denser than the sound absorbing layer 320. For example, in the embodiment illustrated by FIG. 5, the dense or facing layer 322 may be a polypropylene, polyester, and/or PET (Polyethylene terephthalate) material, such as a spunbond/meltblown/spunbond sheet that is 50 grams per square meter (gsm) The facing layer 322 can have any thickness. For example, the facing layer 322, when made from a polymer such as polypropylene or PET, may be between 0.01 and 0.1 cm thick.

The facing layer 322 and the sound absorbing layer 320 can be assembled to one another in a wide variety of different manners. In one exemplary embodiment, a facing layer 322 is bonded to a face of the sound absorbing layer 320 to form a porous/dense laminate 321. The facing layer 322 may be bonded to the sound absorbing layer 320 in a wide variety of different ways. For example, the facing layer 322 may laminated to the sound absorbing layer 320 using heat and/or pressure or the facing layer may be bonded to the sound absorbing layer 320 with an adhesive.

Figure 5A:
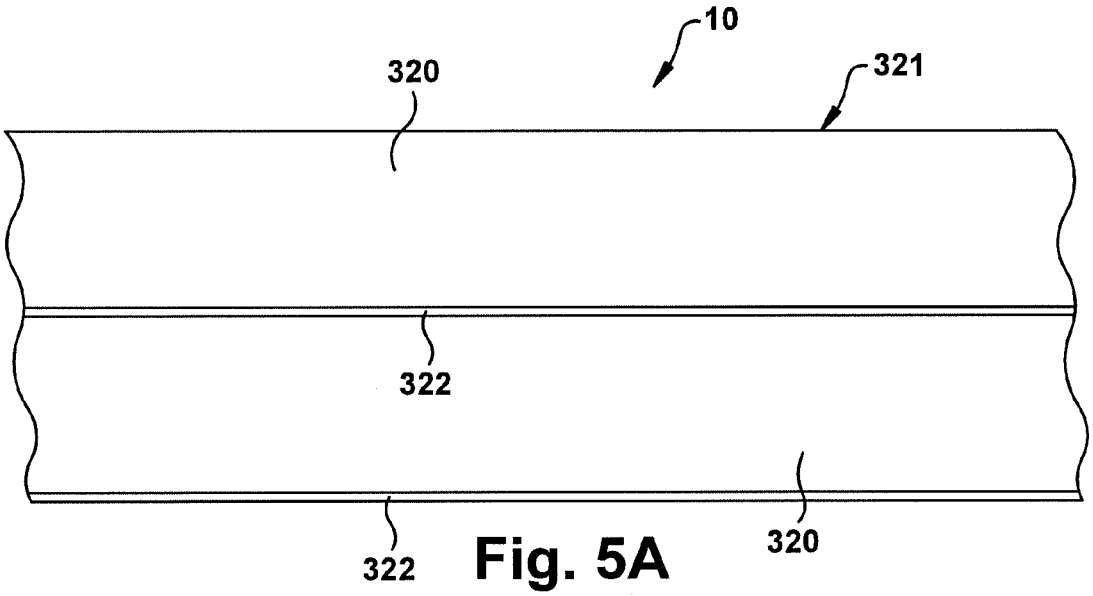
FIG. 5A is a sectional view of another exemplary embodiment of a material of an acoustic insulator.

The acoustic insulator 10 may take a wide variety of different forms and may be made in a wide variety of different ways. The acoustic insulator 10 may have any number of porous, sound absorbing layer 320 and dense or facing layers 322. For example, the acoustic insulator 10 may include any number of alternating dense or facing layers 322 and porous, sound absorbing layer 320 with one porous, sound absorbing layer 320 at one outer surface and one dense or facing layer at the other outer surface (See FIGS. 5, 5A, and 5B for example), any number of alternating dense or facing layers 322 and porous, sound absorbing layer 320 with porous, sound absorbing layers at the outer surfaces (See FIG. 5C for example), and/or any number of alternating dense or facing layers 322 and porous, sound absorbing layer 320 with dense or facing layers at the outer surfaces (See FIGS. 5D and 5E for example). Any arrangement of porous, sound absorbing layers 320 and dense or facing layers 322 can be used.

Figure 5B:
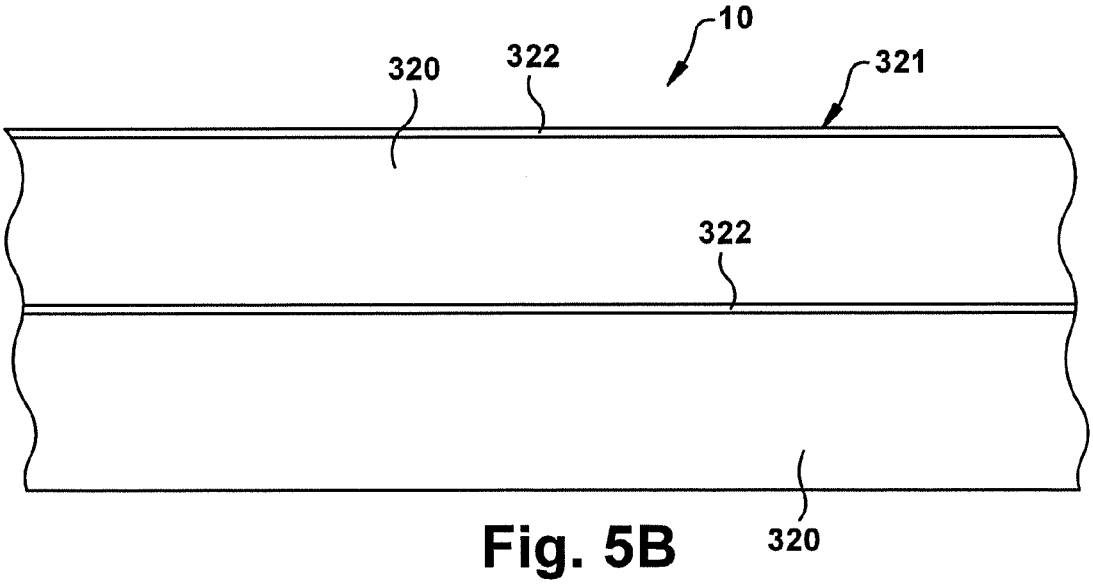
FIG. 5B is a sectional view of another exemplary embodiment of a material of an acoustic insulator.
Figure 5C:
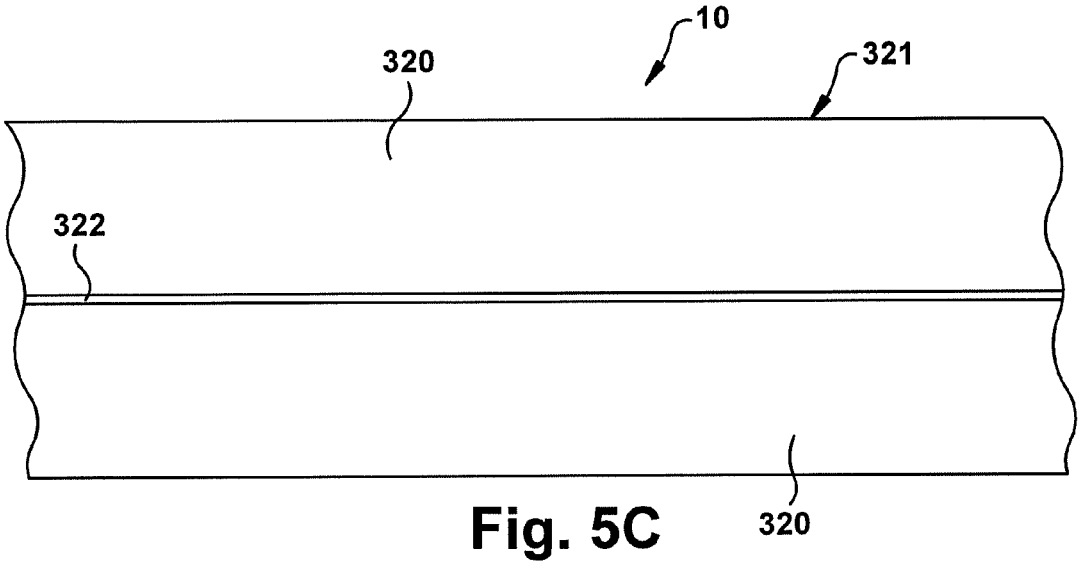
FIG. 5C is a sectional view of another exemplary embodiment of a material of an acoustic insulator.
Figure 5D:
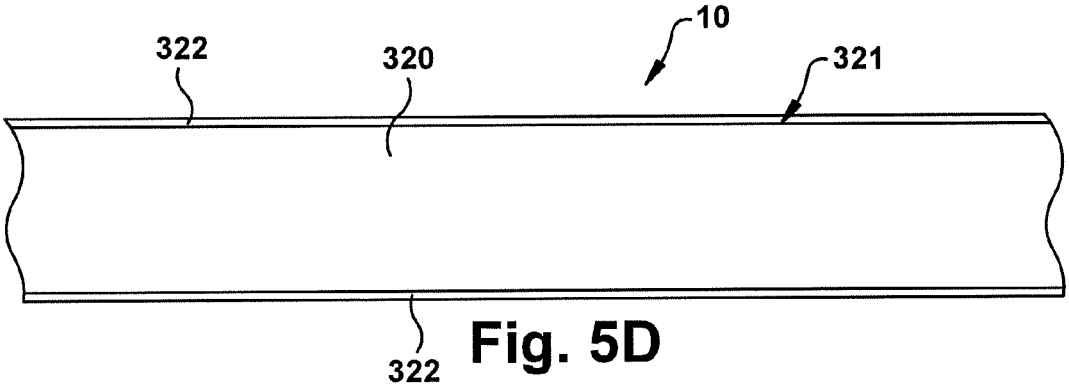
FIG. 5D is a sectional view of another exemplary embodiment of a material of an acoustic insulator.
Figure 5E:
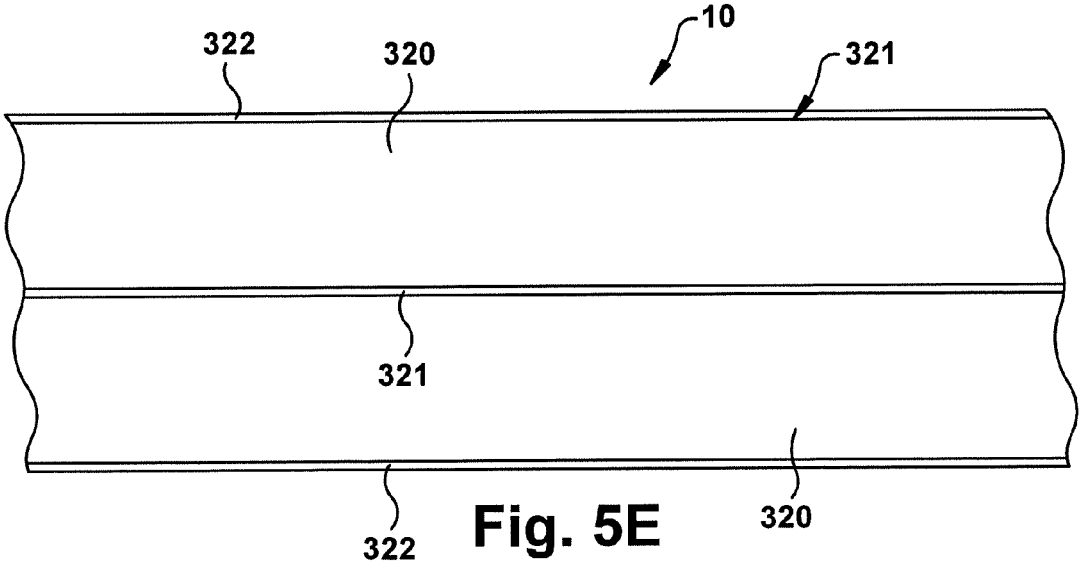
FIG. 5E is a sectional view of another exemplary embodiment of a material of an acoustic insulator.

In one exemplary embodiment, in the example illustrated by FIG. 5B, the top dense layer 320 that faces the washing machine drum is made from polypropylene and the center dense layer 320 is made from polypropylene, polyethylene, and/or PET. In one exemplary embodiment, in the example illustrated by FIG. 5D, the top dense layer 320 that faces the washing machine drum is made from polypropylene and the bottom dense layer 320 that faces the floor is made from polypropylene, polyethylene, and/or PET. In one exemplary embodiment, in the example illustrated by FIG. 5E, the top dense layer 320 that faces the washing machine drum is made from polypropylene and the central dense layer 320 and the bottom dense layer 320 that faces the floor are made from polypropylene, polyethylene, and/or PET.

Figure 6:
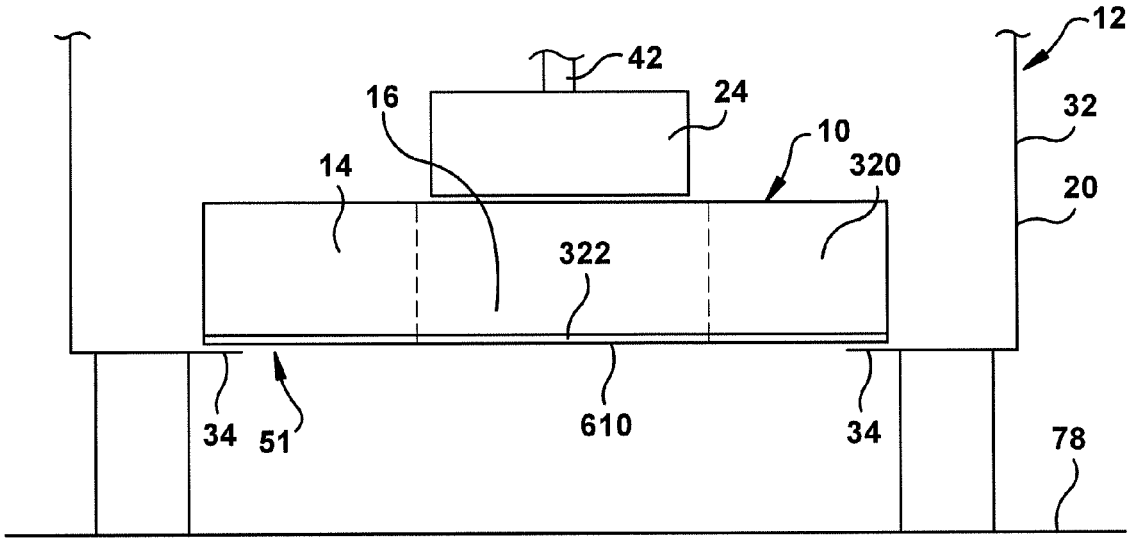
FIG. 6 is a schematic illustration of an exemplary embodiment of an acoustic insulator installed in a cabinet of a washing machine.

As shown in the example illustrated by FIG. 6, the acoustic insulator 10 may be positioned and oriented within the cabinet 20 of the machine 12 in a variety of different ways to reduce the amount of sound energy from the motor 24 that leaves the machine 12. In the illustrated examples, the acoustic insulator 10 is disposed at least partially inside the cabinet 20. The acoustic insulator 10 may be disposed inside any of the walls of the cabinet.

In the examples illustrated by FIG. 6, the acoustic insulator 10 is oriented such that the porous, sound absorbing layer 320 faces toward and optionally engages the motor 24. Low frequency sound energy from the motor passes into the sound absorbing layer 320, which absorbs a large portion of the sound energy. Low frequency sound energy that is not absorbed by the sound absorbing layer 320 reaches the dense or facing layer 322. The dense or facing layer 322 reflects a portion of the low frequency sound energy back into the sound absorbing layer 320, which absorbs a large portion of the reflected sound energy. As such, only a small portion of the low frequency sound energy leaves the cabinet 20. In another exemplary embodiment, the acoustic insulator 10 is oriented such that the dense or facing layer 322 faces toward the motor 24.

In the example illustrated by FIG. 6, the insulation member 10 is disposed in an opening 51 of the cabinet. For example, the insulation member 10 may be disposed in an opening 51 in any of the walls of the cabinet. In an exemplary embodiment, the insulation member is soft and/or flexible enough to be folded and/or compressed to fit into the opening 51. In this embodiment, the insulation member 10 is also resilient enough to substantially return to its original size and shape to retain the insulation member 10 in the opening 51 without requiring fasteners, adhesive or other means for holding the insulation member 10 in the opening 51. In the example illustrated by FIG. 6, the insulation member 10 is disposed in a bottom opening 51 of the cabinet 20.

Figure 6A:
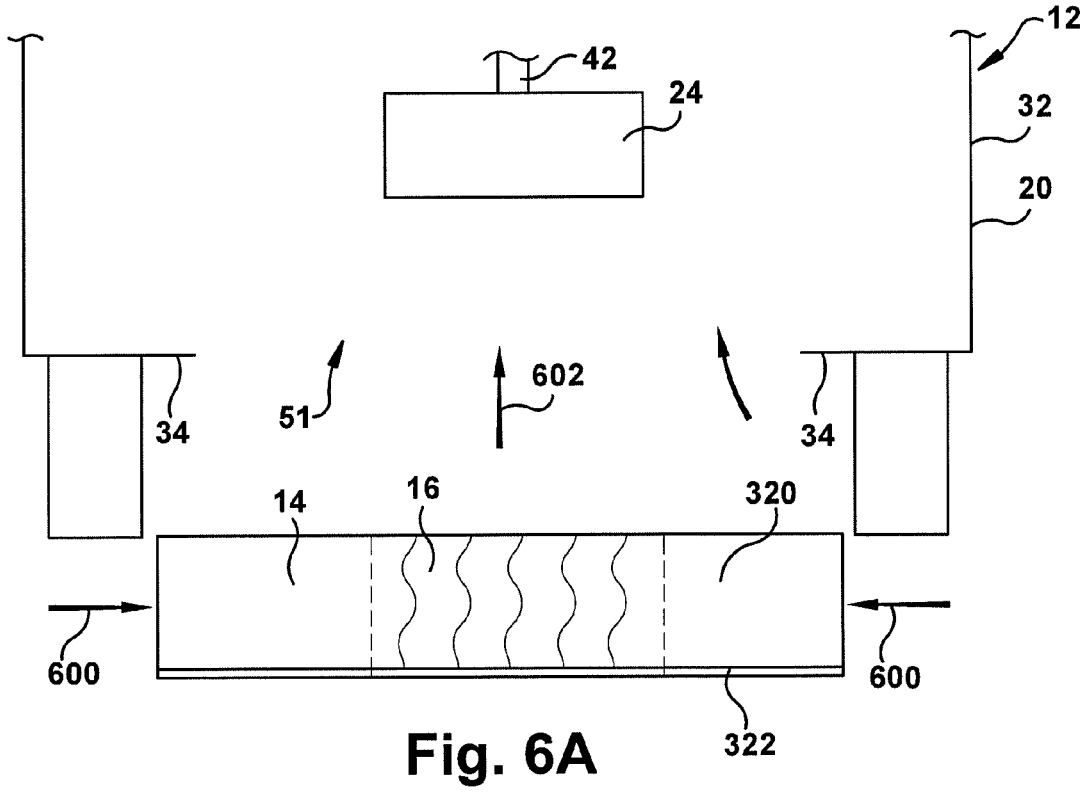
FIG. 6A is a schematic illustration of an exemplary embodiment of an acoustic insulator being installed in a cabinet of a washing machine.

Referring to FIG. 6A, the acoustic insulator 10 may be assembled with the cabinet 20 by compressing or folding up the acoustic insulator 10 as indicated by arrows 600. The acoustic insulator 10 is then moved upward as indicated by arrow 602 to place the acoustic insulator 10 in the bottom opening 51 of the cabinet 20. Referring to FIG. 6, the acoustic insulator 10 is released and/or unfolded such that the acoustic insulator 10 is retained in the bottom opening 51 without requiring any fasteners or adhesive. The acoustic insulator 10 may be sized and/or shaped in a wide variety of different ways to facilitate retention in the bottom opening 51. In the illustrated embodiment, an outer periphery of the acoustic insulator 10 is sized to rest on the flange 34 that defines the bottom opening 51.

The acoustic insulator 10 is positioned between the motor 24 and a floor 78 that supports the cabinet 20 of the clothes washing machine 12. As such, the acoustic insulator 10 absorbs low frequency sound energy generated by the washing machine motor 24. As such, the acoustic insulator 10 inhibits sound energy generated by the washing machine motor 24 from exiting through the bottom opening 51. In this illustrated example, a bottom surface 610 of the acoustic insulator 10 is spaced apart from the floor 78 that supports cabinet 20. In an exemplary embodiment, the bottom surface 610 of the moveable portion 16 moves close to the floor 78 when the tub 22 is filled with water 25. The moveable portion 16 may move into engagement with the floor 78 when the tub 22 is filled with the water. In another embodiment, a gap between the floor 78 and the moveable portion 16 remains when the tub 22 is filled with water 25. In either case, a portion of the sound energy that leaves the acoustic insulator 10 is reflected off of the floor 78 and back to the acoustic insulation member 10. A portion of this reflected sound energy is absorbed by the acoustic insulator 10.

The acoustic insulator 10 may take a wide variety of different forms. For example, the acoustic insulation member may have any of the multi-layer configurations of the insulation member 16 described by pending U.S. patent application Ser. No. 13/114,446, filed May 24, 2011, titled "ACOUSTICALLY INSULATED MACHINE," which is incorporated herein by reference in its entirety. In addition, the acoustic insulator 10 may be constructed from a single layer of material having uniform properties throughout or a single layer having non-uniform properties.

Figure 7:
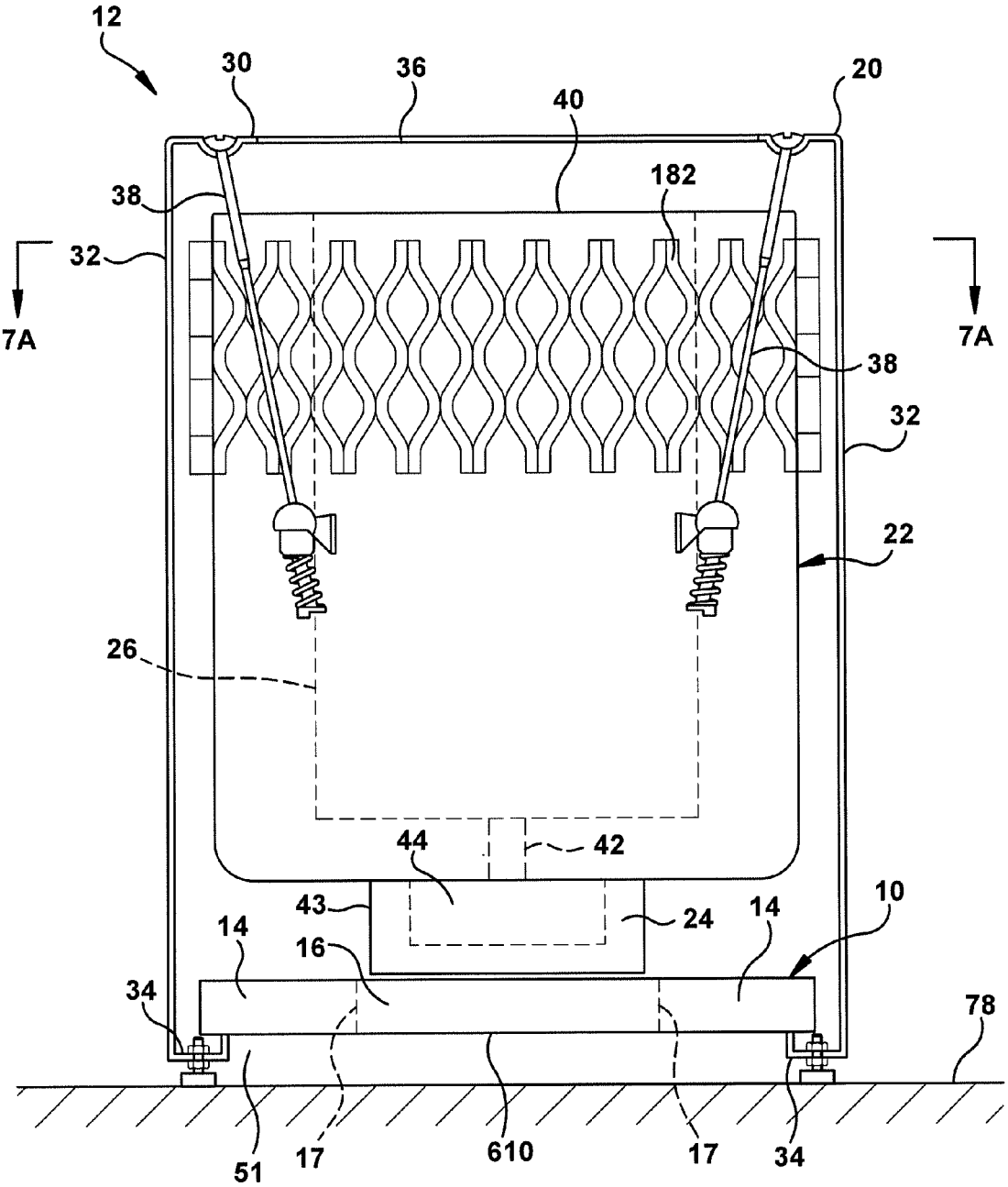
FIG. 7 is a schematic illustration of an exemplary embodiment of a washing machine having an acoustic insulator with a moveable portion and a damping element disposed around a tub of the machine.
Figure 8:
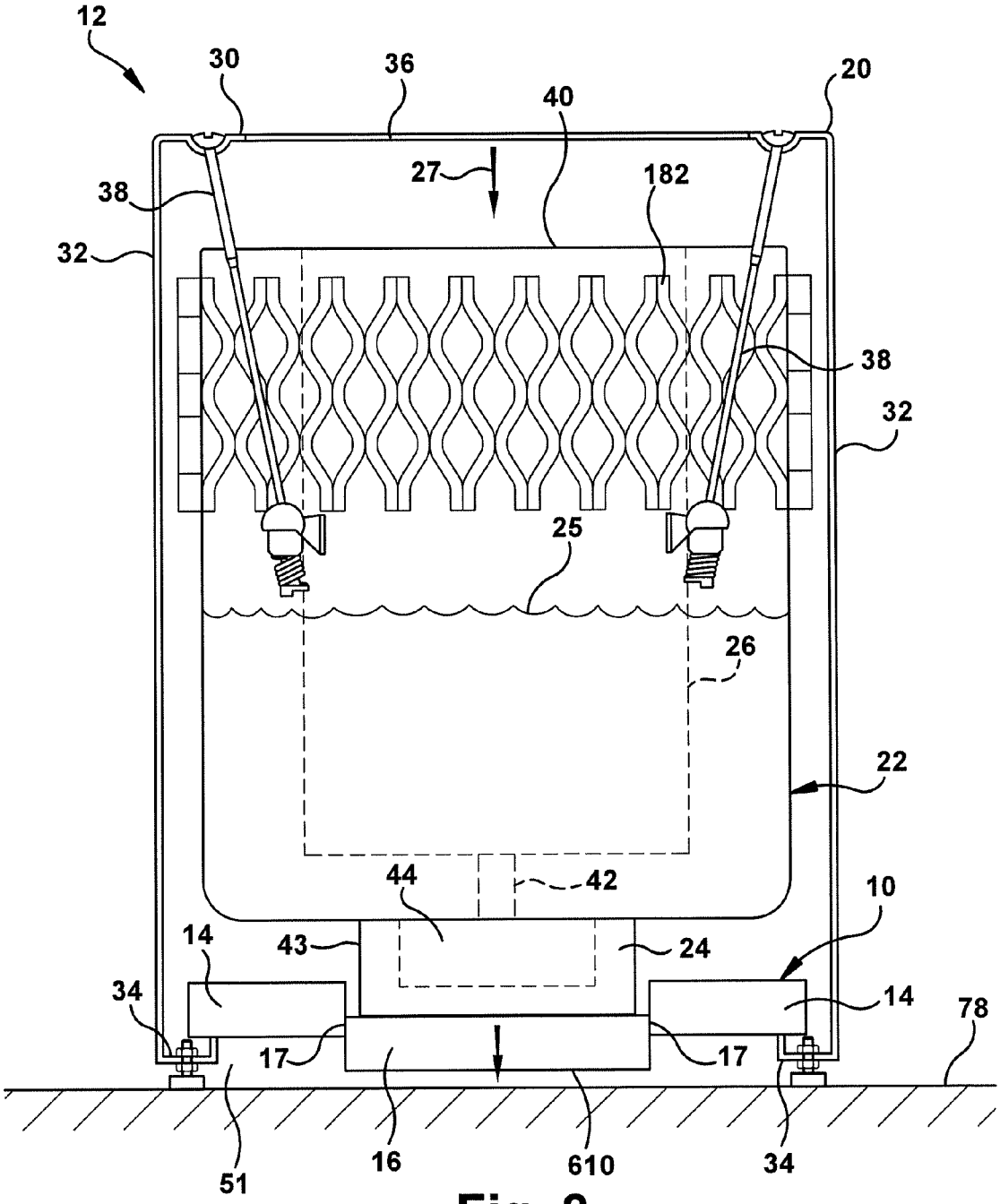
FIG. 8 is a view of the washing machine of FIG. 7 with the moveable portion moved downward.

FIGS. 7 and 8 illustrate a washing machine 12 that includes an insulator 10 of any of the exemplary embodiments disclosed above and a damping element 182 disposed around the tub 22. The damping element 182 can take a wide variety of different forms. For example, the damping element 182 can take the form of the damping elements disclosed by U.S. patent application Ser. No. 13/071,995, filed on Mar. 25, 2011, titled "WASHING MACHINE SHIPPING SYSTEM AND METHOD," and/or PCT Published Application No. WO2011084953A2 which are incorporated herein by reference in their entireties.

In one exemplary embodiment, a washing machine 12 includes an insulator 10 with a single porous sound absorbing layer 320 and a single facing layer 322 and a damping element 182 disposed around the tub 22. For example, a washing machine 12 may include an insulator 10 with a single porous sound absorbing layer 320 having a thickness of 6 mm and 40 mm and a density of 8 grams and 80 grams per square foot and a single facing layer 322 having an airflow resistance of greater than 600 Rayls, for example between 800 and 1200 Rayls and a damping element 182 disposed around the tub 22. Applicant has found that this configuration is exceptionally effective at reducing noise emitted by the washing machine. The acoustic insulator 10 in this configuration may optionally have the moveable portion 16 and the interface 14 described herein. However, this configuration need not necessarily be employed. For example, a damping element 182 can be used without an acoustic insulator 10, an acoustic insulator 10 may be used without a damping element 182, or an acoustic insulator may be used that has a configuration other than a one porous sound absorbing layer/one facing layer configuration.

Figure 7A:
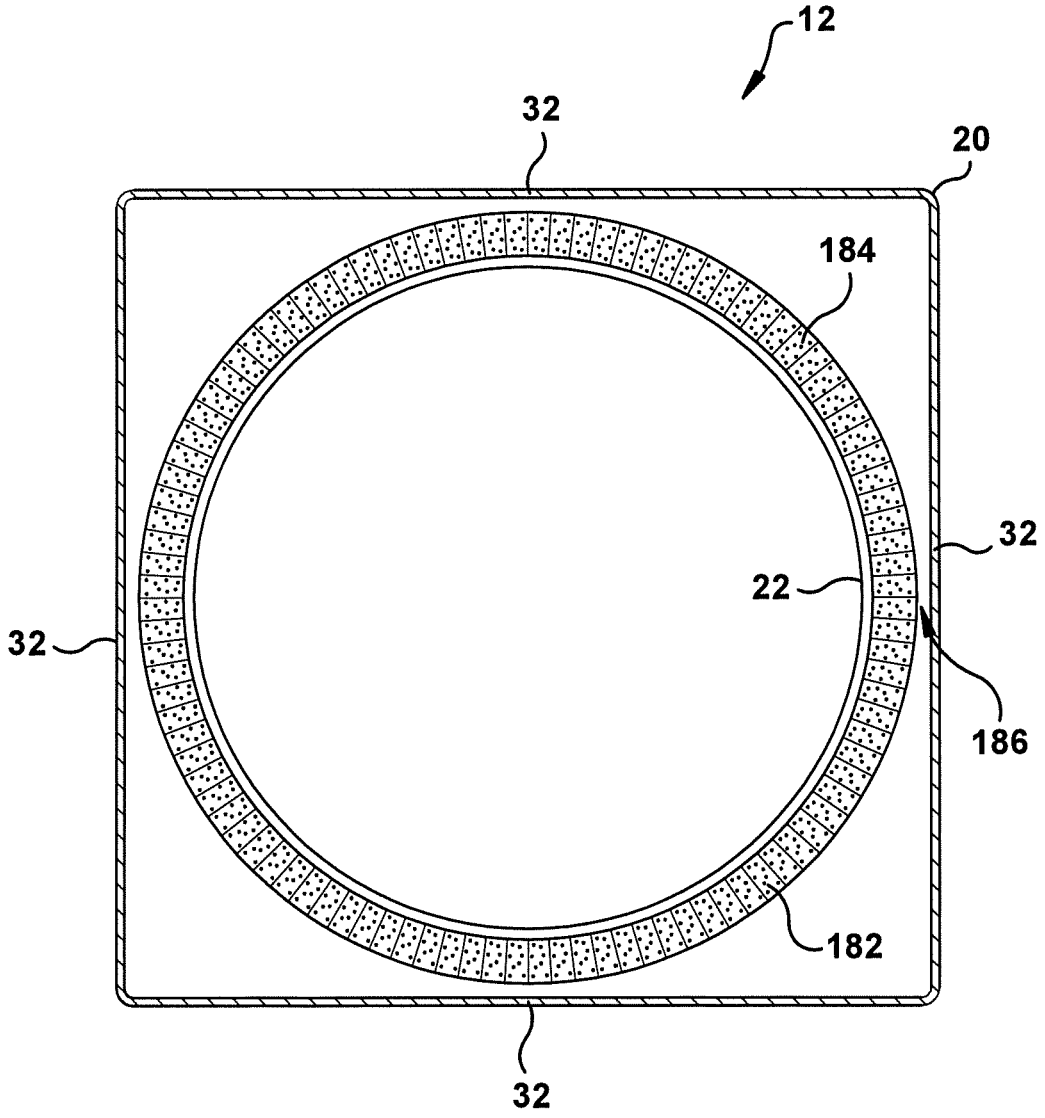
FIG. 7A is a top sectional view taken along the plane indicated by lines 7A-7A in FIG. 7.
Figure 7B:
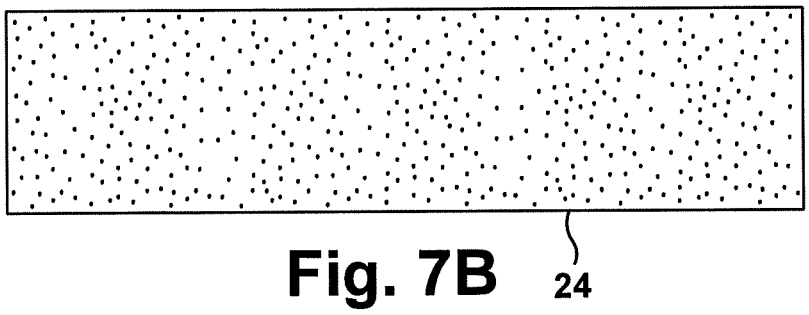
FIGS. 7B, 7C, and 7D illustrate exemplary configurations of material that can be used to form a damping element that can be disposed around a tub as shown in FIGS. 7 and 7A.
Figure 7C:
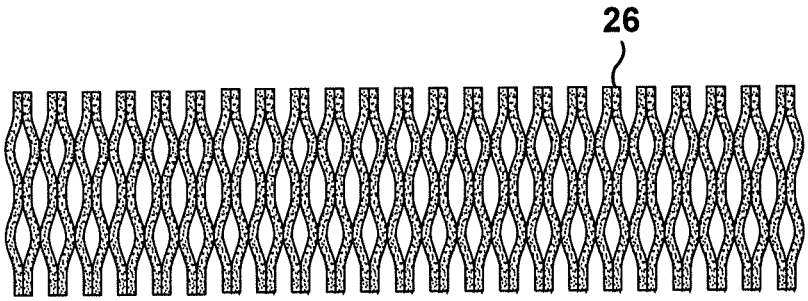
Figure 7D:
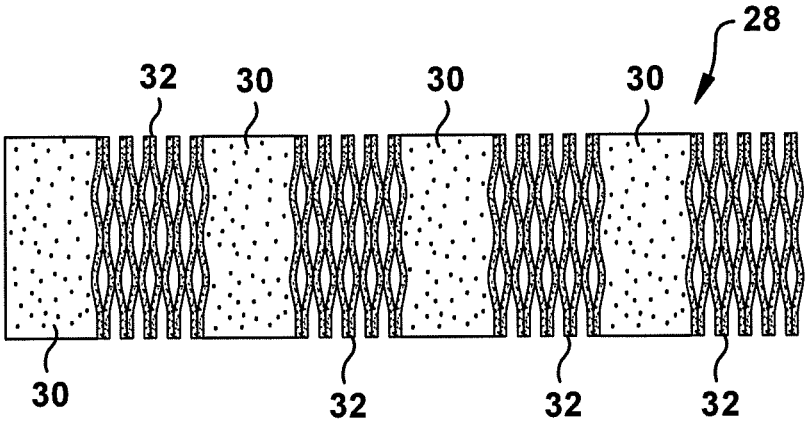

In the example illustrated by FIGS. 7 and 7A, the damping element 182 is formed of a sleeve 184 of resilient material that is stretched over and/or attached to the tub 22. The sleeve 184 may be attached to the tub 22 in any desired manner, including the non-limiting examples of using mechanical fasteners and/or adhesives or by a friction fit. While the embodiment illustrated in FIG. 7 shows the damping element 182 as having a latticework pattern, it should be appreciated that the damping element 182 can have other desired patterns or a solid sheet with no pattern (see for example, the patterns illustrated by FIGS. 7B, 7C, and 7D).

In the illustrated embodiment, the damping element 182 is made from a fibrous polymeric material, such as for example polyester. In other embodiments, the damping element 182 can be made from other desired materials, including the non-limiting examples of a polyester olefin blend, polyethylene terephthalate, polybutylene terephthalate, a polyethylene terephthalate and polypropylene blend, a polybutylene terephthalate and polypropylene blend and combinations thereof. In still other embodiments, the damping element 182 can be made from laminated materials including a core layer of fiberglass reinforced polymer material sandwiched between layers of polyester material.

The use of polymeric materials provides the damping element 182 with excellent resiliency and wear resistance to provide a long service life. At the same time, the acoustic properties of the fibrous polymeric material may be tuned to better control noise and vibration. This may be done by adjusting the density as well as the diameter and length of the fibers utilized in the damping element 182. It should also be appreciated that the damping element 182 can be further tuned to provide a desired spring rate for maximizing the damping of the horizontal energy or motion of the tub 22 within the cabinet 20.

Referring again to FIG. 7A, a gap 186 is formed between the damping element 184 and the cabinet 20. The gap 186 is configured so as to not impair the rotational movement of the tub 22 during start and stop movements of the washing machine 12. The damping element 182 remains positioned around the tub 22 for the life of the washer 12.

In addition, it should be appreciated that the damping element 182 may be tuned to provide the desired spring rate for the most effective damping of horizontal energy or motion of the tub 22 within the cabinet 20. Typically, the damping element 182 provides a spring rate of between about 6.5 and about 102.0 pounds of force per 100 square inches of contact area. However, this is not critical as long as the sleeve provides the appropriate protections during shipping and/or operation.

The spring rate range desired for optimum energy dampening is dependent upon the weight of the tub 22, the cabinet-to-tub wall gap G (which may be an air gap) and the weight of wet clothes contained in the tub. A gap G is provided between the dampening element 14/sleeve 22 and the cabinet wall so as to not impair the torque movement of the tub 22 during start and stop movements.

The loft of the material determines how soon the tub 22 starts meeting resistance to slow the horizontal energy or momentum of the tub 22 as it moves toward contact with the sidewall 32 of the cabinet 20. The more the material of the damping element 182 is compressed between the tub 22 and sidewall 32 during horizontal movements, the higher the spring rate of the material and the stronger the damping of the horizontal energy. Thus, it should be appreciated that the damping element 182 made from the lattice material may be effectively "tuned" for a number of different applications. By increasing the amount of solid material in the lattice the spring rate may be increased. Conversely, by reducing the amount of solid material in the lattice, the spring rate of the material may be reduced. Thus, by selecting a proper lattice and adjusting the loft or thickness of the lattice to between about 20.0 and about 50.0 mm it is possible to tune the spring rate to a desired level for the most efficient and effective damping of horizontal energy. Typically the lattice will include between about 10 and about 90 percent solid material and between about 90 and about 10 percent open space.

As illustrated in FIG. 7, dampening element 182 need not extend to the top and bottom of the tub 22, but can occupy portions in between. In alternative embodiments, dampening element 182 can extend to the upper and lower extremities of the tub 22. Hence, more or less of the tub 22 can be covered by dampening element 182. Furthermore, dampening element 182 can be made of a plurality of damping elements 182 around the tub 22, which may or may not be adjacent to each other. In this manner, the dampening element 182 can be formed by an assembly of components. Still further, dampening element 182 may extend partially or completely along tub 22 and may be continuous or discontinuous.

During operation, the damping element 182 reduces and controls horizontal motion of the tub 22 toward the sidewalls 32 of the cabinet 20. This reduces noise and vibration so as to provide smoother and more silent operation. Use of a polyester material for the damping element 182 provides a very resilient and scuff resistant damping element so as to provide a long service life without any significant degradation of desired damping properties. Other materials may be used which have similar properties.

Figure 9:
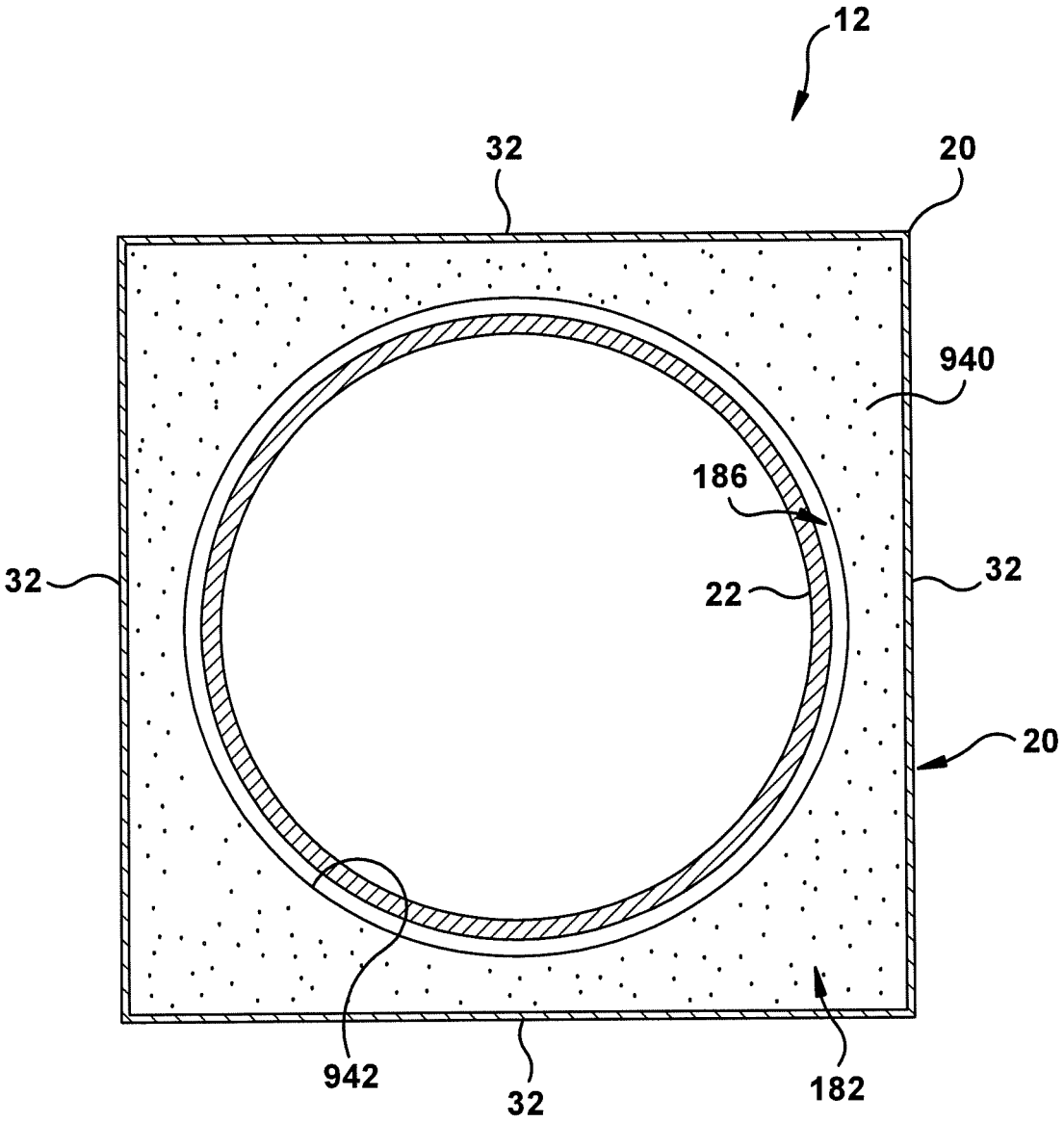
FIG. 9 is a view similar to the view of FIG. 7A showing another exemplary embodiment of a damping element.

An alternative embodiment of the damping element 182 is illustrated in FIG. 9. In this embodiment the damping element 182 comprises a block 940 of resilient material that is secured to the sidewalls 32 of the cabinet 20. The block 940 of resilient material includes a tub opening 942. As should be appreciated the tub 22 extends through the opening 942. A small space or clearance air gap 186 is provided between the tub 22 and the tub opening 942 so that the torque movement of the tub 22 during start and stop movements is not impaired in any way. In other embodiments, gap G may extend partially or completely along tub 22 and may or may not be in contact with tub 22.

It should be appreciated, however, as the tub 22 moves horizontally under load from, for example, uneven weight distribution of clothes in the tub 22 during a spin cycle, the tub 22 engages and compresses the horizontal energy damping block 940. The resilient spring property of the material then dampens that horizontal movement. As described earlier, the block 940 need not extend to the upper and bottom extremities of tub 22, but may be positioned at portions in between.

Figure 10A:
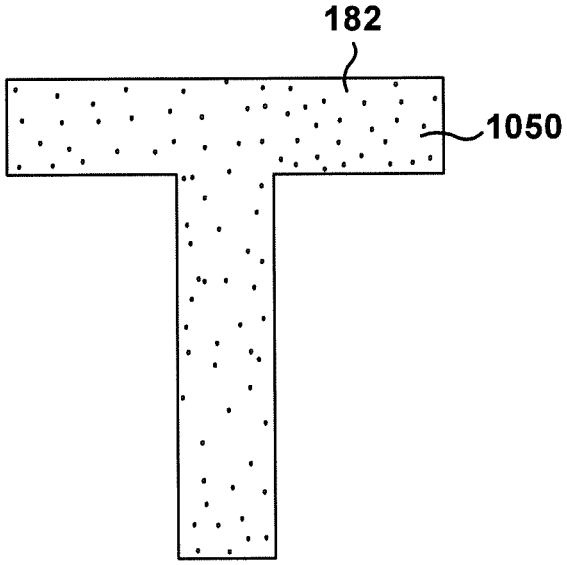
FIG. 10A is an illustration of another exemplary embodiment of a damping element.
Figure 10B:
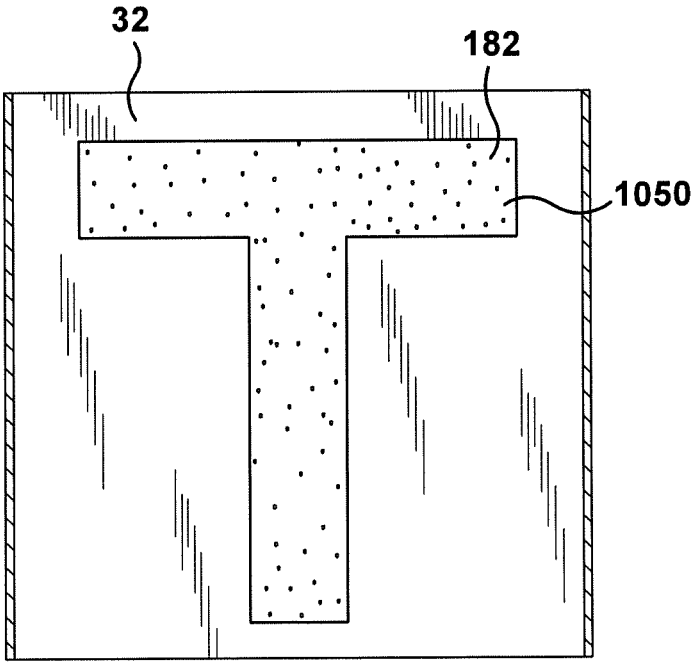
FIG. 10B is an illustration of the damping element shown in FIG. 10A attached to a cabinet of a washing machine.

Still another alternative embodiment of the damping element 182 is illustrated in FIGS. 10A and 10B. As illustrated in FIG. 10A, this embodiment of the damping element 182 comprises a substantially T-shaped pad 1050. As illustrated in FIG. 10B such a T-shaped pad 1050 is mounted to each sidewall 32 of the washer 12. A small space or clearance gap is provided between each of the T-shaped pads 1050 and the tub 22 when the tub 22 is in its steady state position. However, whenever the tub 22 moves horizontally under loading during operation of the washer, the tub 22 engages one or more of the pads 1050, compressing the pad. The resilient spring property of the material used to construct the pad 1050 provides damping of that horizontal energy as the material compresses thereby controlling and limiting horizontal movement and vibration.

The block 940 and T-shaped pads 1050 of the two alternative embodiments may be made from the same material of the sleeve 184. Thus, each embodiment of the damping element 182 provides the desired resiliency and spring rate for effective damping of horizontal energy and the necessary strength and abrasive resistance to function as desired for a long service life. In other embodiments, pad 1050 can be made from different shapes such as, for example and I-shape, only an upper horizontal portion of a T-shape, etc.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasable or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A home appliance comprising:

a source of noise that moves between a first position that corresponds to the appliance being empty and a second position that corresponds to the appliance being loaded during operation of the appliance; and an acoustic insulator having a movable portion that moves with the source of noise between the first position and the second position and an interface that remains substantially stationary as the source of noise moves between the first and second positions;

wherein the moveable portion and the interface are made from the same material;

wherein the acoustic insulator includes a series of cuts through the acoustic insulator to allow the moveable portion to move with respect to the interface between the first and second positions.

2. The home appliance of claim 1 wherein the home appliance is a washing machine and the source of noise is a motor of the washing machine.

3. The home appliance of claim 2 wherein the acoustic insulator is disposed in a bottom opening of a cabinet of the washing machine.

4. The home appliance of claim 3 wherein the washing machine includes a tub that moves downward when the tub is filled with water, wherein the motor is attached to the tub and moves downward with the tub when the tub is filled with water, wherein the moveable portion moves downward with the tub and the motor when the tub is filled with water, and wherein the interface remains stationary when the tub is filled with water.

5. The home appliance of claim 1 wherein the acoustic insulator is formed from a single piece of material.

6. The home appliance of claim 5 wherein the movable portion is coupled to the interface by a coupling arrangement.

7. The home appliance of claim 1 wherein the movable portion is coupled to the interface by a coupling arrangement.

8. A home appliance comprising:

a source of noise that moves between a first position that corresponds to the appliance being empty and a second position that corresponds to the appliance being loaded during operation of the appliance; and an acoustic insulator having a movable portion that moves with the source of noise between the first position and the second position and an interface that remains substantially stationary as the source of noise moves between the first and second positions;

wherein the moveable portion and the interface are made from a single piece of material;

wherein the acoustic insulator includes a series of cuts through the acoustic insulator to allow the moveable portion to move with respect to the interface between the first and second positions.

9. The home appliance of claim 8 wherein the home appliance is a washing machine and the source of noise is a motor of the washing machine.

10. The home appliance of claim 9 wherein the acoustic insulator is disposed in a bottom opening of a cabinet of the washing machine.

11. The home appliance of claim 10 wherein the washing machine includes a tub that moves downward when the tub is filled with water, wherein the motor is attached to the tub and moves downward with the tub when the tub is filled with water, wherein the moveable portion moves downward with the tub and the motor when the tub is filled with water, and wherein the interface remains stationary when the tub is filled with water.

* * * * *